United States Patent [19]

Moore et al.

[11] 4,220,549

[45] Sep. 2, 1980

[54] METHOD FOR REMOVING REFLECTIVE DECAL

[75] Inventors: Ronnie J. Moore, Columbus; Walter H. Burrows, Atlanta, both of Ga.

[73] Assignee: Ronnie J. Moore, Smyrna, Ga.

[21] Appl. No.: 902,801

[22] Filed: May 4, 1978

[51] Int. Cl.[2] ..... C11D 7/52

[52] U.S. Cl. ..... 252/171; 252/162; 252/170; 252/172; 134/4; 134/6; 134/38

[58] Field of Search ..... 252/171, 170, 162, 172; 134/4, 6, 38

[56] References Cited

U.S. PATENT DOCUMENTS

| | | | |
|---|---|---|---|
| 3,625,763 | 12/1971 | Melillo | 134/6 |
| 3,661,641 | 5/1972 | Vigh et al. | 134/6 |
| 3,737,386 | 6/1973 | Geiss et al. | 134/38 X |
| 3,856,695 | 12/1974 | Geiss et al. | 134/38 X |
| 3,920,472 | 11/1975 | Vinson | 134/38 X |
| 3,950,185 | 4/1976 | Toyama et al. | 134/38 |

OTHER PUBLICATIONS

"Methocel", p. 22, Dow Chemical, 1952.
"Carbowax", p. 20, Union Carbide, 1960.

*Primary Examiner*—Mayer Weinblatt
*Attorney, Agent, or Firm*—Jones, Thomas & Askew

[57] ABSTRACT

A method for removing a reflective decal from a vehicle's body surface, especially a baked enamel surface as would be found on a truck or an automobile. The method includes the steps of contacting the decal, for a period of time sufficient to loosen the decal from the surface, with a composition consisting essentially of methylene chloride, a lower alkyl alcohol, a lower aliphatic symmetric or unsymmetric ketone, methyl cellulose and polyethylene glycol, and separating the loosened decal from the surface with a high pressure stream of liquid.

8 Claims, No Drawings

METHOD FOR REMOVING REFLECTIVE DECAL

The present invention relates to a method for removing decals from vehicle body surfaces. More particularly, the present invention relates to a method for removing reflective decals from baked enamel surfaces or uncoated metal surfaces as would be found on trucks and automobiles.

The great majority of the commercial trucks on the highway today include reflective decals on their body surfaces. These reflective decals are used to spell out a company's name, or display a slogan or picture while also making the truck more visible at night.

The decals are normally constructed from an acrylic material and are secured to the vehicle surface with an adhesive specifically designed to keep the decal in place for a long period of time and through exposure to a wide variety of temperatures, weather conditions, washings and commonly encoutered solvents.

Therefore, when a trailer is transferred from one company to another or when the owner merely wishes to change the decals on his truck, some method must be used to remove the old decals. However, due to the nature of the decals and the adhesives used to adhere them to a surface, the decals are very difficult to remove by conventional means. This is particularly true of decals that have been attached for long periods of time.

A method of removing these decals using a chemical composition which could be applied to loosen these decals from a surface has long been sought. Heretofore, no known method performs satisfactorily in removing these decals.

SUMMARY OF THE INVENTION

It has now been found that reflective decals may be quickly, easily and effectively removed from surfaces by contacting the decal, for a period of time sufficient to loosen the decal from the surface, with a composition consisting essentially of methylene chloride, a lower alkyl alcohol, a lower aliphatic symmetric or unsymmetric ketone, polyethylene glycol and methyl cellulose; and physically separating the loosened decal from the surface.

Accordingly, it is an object of the present invention to provide an improved method for removing a reflective decal.

A further object of the present invention is to provide a method for removing a reflective decal which uses a chemical composition to loosen the decal from the surface to which it is adhered.

Another object of the present invention is to provide a method for removing a reflective decal which is effective at removing decals that have been adhered to a surface for a long period of time.

These and other objects, features and advantages of the present invention will become apparent from a review of the following detailed description of a preferred embodiment of the invention and the appended claims.

DETAILED DESCRIPTION OF A PREFERRED EMBODIMENT

The chemical composition of the present invention which is useful for removing reflective decals contains methylene chloride, a lower alkyl alcohol, a lower aliphatic symmetric or unsymmetric ketone, polyethylene glycol and methyl cellulose.

Methylene chloride, when applied to a reflective decal, attacks the material of the decal and the adhesive binding it to a surface. Methylene chloride is preferred because of its level of activity and its low level of toxicity as compared with other halogenated hydrocarbons. Since the composition is usually applied to relatively large areas, such as the entire surface area of a semi-trailer truck, the level of toxicity of the fumes is an important consideration.

The degree of dilution of the methylene chloride with a lower alkyl alcohol is dependent upon a number of factors, such as the age of the decal and the thickness of the decal. Where the decal is relatively easy to remove, the methylene chloride may be diluted to a greater degree. Conversely, where the decal is relatively difficult to remove, the methylene chloride should be applied in greater strength. Although it would be possible to use lower alkyl alcohols, such as isopropyl alcohol or ethyl alcohol, methyl alcohol is preferred.

The useful range of concentration of methylene chloride in the composition of the present invention is approximately 30–70%, preferably 59% by weight, with a useful range of concentration of the diluent, methyl alcohol, being approximately 10–40%, preferably 26% by weight.

It is desirable to add additional solvents to the methylene chloride. These additional solvents include particularly ketones, with the lower aliphatic ketones being most preferable. It is found that methyl ethyl ketone is a particularly good solvent for the reflective decals and decal adhesives and is therefore a particularly preferable additional solvent. The amount of methyl ethyl ketone added to the composition of the present invention is approximately 3–10%, preferably 4% by weight.

Since methylene chloride, methyl alcohol and methyl ethyl ketone are all quite volatile, it is possible that after the decal had been loosened from the surface that the evaporation of the volatile constituents would cause the decal to readhere to the surface. Therefore, it is desirable to provide an additional constituent which prevents the decal from readhering. It has been found that the addition of a small quantity of polyethylene glycol, having an average molecular weight of approximately 1,500, is quite useful for this purpose. Such a polyethylene glycol is commercially available under the name Carbowax 1500, manufactured by Union Carbide. The amount of polyethylene glycol useful in the composition of the present invention is approximately 5–15%, preferably 9% by weight.

Additionally, it is often desirable to vary the viscosity of the composition depending on the nature of the surface to which it is applied. For substantially vertical surfaces, as would be found on the side of a truck, it is preferred to increase the viscosity of the composition to prevent it from running down the surface before it has chemically loosened the decal. Various viscosity increasing agents, such as methyl cellulose may be used. Methyl cellulose is commercially available under the name Methocel, manufactured by Dow Chemical. For general use in the method of the present invention, the viscosity of the composition should be adjusted to provide a consistency of a light, almost fluid gelatin preparation. It is found that approximately 1–4%, preferably 2% by weight methyl cellulose renders a composition having the desired viscosity useful in the present invention.

The method by which a reflective decal is removed from a surface using the above described chemical composition involves essentially four steps.

The first step is preparing the surface and the decal to be removed. Since the presence of water on the surface tends to make the surface unreceptive to the composition, it is desirable to dry the surface before applying the chemical composition. A dry surface will therefore allow the composition to achieve its maximum efficiency.

The second step is applying the chemical composition to the decal. It is preferable to apply the composition by spraying with either an airless sprayer or a low pressure air sprayer being preferred. For small surfaces, the composition may be applied by brushing. However, if brushing is used, it has been found that the best method of application is to use brush strokes in only one direction which permits the composition to be flowed onto the decal. In this manner, premature drying of the chemical composition is minimized.

It should be noted that if any parts adjacent the decal are made of plastic or other material, which could be damaged by the chemical composition, they should be covered to prevent damage.

The third step is leaving the chemical composition in contact with the decal for a time sufficient to loosen the decal. This length of time is dependent upon the temperature of the surface, the decal and the surrounding air. At cooler temperatures, the composition must be left in contact with the decal for a longer time; at higher temperatures a shorter time is necessary. When dealing with customarily encountered temperatures, such as 60°-80° F., the average time required is approximately 10 minutes. At temperatures of 35° F. or below, the time for the composition to loosen the decal is too long to be practical. Furthermore, at temperatures above 100° F., the volatile components of the composition will evaporate too fast to allow sufficient contact time to chemically loosen the decal. The ambient temperature and the temperature of the surface and decal should therefore be approximately 40°-100° F., preferably 60°-80° F.

A visual indication of separation of the decal from the surface may also be made. The decal takes on a cracked or shattered appearance when the chemical composition has effectively loosened it from the surface.

The fourth step is physically separating the chemically loosened decal from the surface. The decal can be physically separated by almost any traditional technique, such as rubbing with steel wool or scraping with a squeegee or a knife, or the like. However, it has been found that physically separating the decal using a high pressure stream of water is most effective. A conventional high pressure washing apparatus having a nozzle which produces a fan-shaped spray may be used. Pressure of the water leaving the nozzle should be in the range of 300-1000 psi. The loosened decal can be removed from the surface by applying the spray to the decal in a slicing motion progressively lifting sections of the decal from the surface.

The use of a high pressure stream of water has the advantage of mechanically removing any excess unreacted methylene chloride on the surface. Furthermore, all the other ingredients of the composition are soluble in water and may be effectively removed by the stream of water to provide a clean surface.

It should be understood that other methods may be effectively used to mechanically separate the decal. Use of various temperatures of water for the stream are specifically contemplated. Also, the use of steam under pressure instead of, or in combination with, water is also contemplated. In fact, almost any fluid substance under pressure could conceivably be used effectively with the present method.

Using the foregoing method, a reflective decal can usually be removed in one application of the chemical composition. However, if a particularly stubborn decal is encountered, repeated applications of the chemical composition may be used.

The following example is given by way of illustration and it should be understood that the invention is by no means limited to the specific example.

EXAMPLE 1

This example demonstrates a chemical composition for use in the method of the present invention which is particularly useful for removing acrylic decals, such as Scotch Lite decals made by 3M Company, from a baked enamel surface, such as would be found on the side panels of a truck.

The chemical composition consists of the following components in which all percentages are by weight:

| | |
|---|---|
| Methylene chloride | 58.7% |
| Methyl alcohol | 26.1% |
| Methyl ethyl ketone | 4.3% |
| Polyethylene glycol (M.W. approx. 1,500) | 8.7% |
| Methyl cellulose | 2.2% |

The above chemical composition is prepared by combining 270 lbs. methylene chloride, 120 lbs. methyl alcohol and 20 lbs. methyl ethyl ketone in a covered vessel equipped with a stirrer. 40 lbs. of polyethylene glycol are slowly added to the vessel and stirring is continued until the material is completely dissolved. With fairly vigorous stirring, 10 lbs. of methyl cellulose are sprinkled into the vessel so that it is uniformly dispersed in the liquids. Stirring is continued for approximately 1 hour until all solids are dispersed in the liquid and it is free of lumps or other aggregates. The resulting mixture is water-white and clear. It has the consistency of a light, almost fluid gelatin preparation.

A truck having a Scotch Lite reflective decal which has been attached to the truck's baked enamel surface for over 3 years is brought into a warehouse and permitted to equilibrate with the ambient temperature of 68° F. A small section of the decal is selected for testing. The decal is dried with a cloth and a smooth even coating of the chemical composition described above is flowed onto the decal with a brush. The chemical composition is permitted to remain in contact with the decal for 10 minutes, after which the decal assumes a shattered or cracked appearance.

A high pressure water stream, delivering a fan-shaped spray of water at a temperature of 50° F. and a pressure of 350 psi, is directed at the reflective decal. A slicing motion of the stream of water is used to progressively lift sections of the decal from the surface of the truck.

After the last section of the decal is removed, the surface is clean of any excess of the chemical composition. The surface need only be permitted to dry and it is ready for the application of a new decal or further treatment of the surface.

It should be understood, of course, that the foregoing relates to a preferred embodiment of the present invention and that numerous modifications or alterations may be made therein without departing from the spirit and scope of the invention as set forth in the appended claims.

What is claimed is:

1. A method of removing acrylic and polyester reflective decals from a surface comprising the steps of:

contacting said decal, for a period of time sufficient to loosen said decal from said surface, with a composition consisting essentially of approximately 30%—70% by weight methylene chloride and approximately 10%—40% by weight methyl alcohol; and separating said loosened decal from said surface.

2. The method of claim 1 wherein the composition consists essentially of:

| | (% by weight) |
|---|---|
| methylene chloride | 30–70% |
| methyl alcohol | 10–40% |
| methyl ethyl ketone | 3–10% |
| polyethylene glycol | 5–15% |
| methyl cellulose | 1–4% |

3. The method of claim 1, wherein said percentage by weight of methylene chloride is 59%.

4. The method of claim 1, wherein said percentage by weight of methyl alcohol is 26%.

5. The method of claim 1, wherein said step of separating said loosened decal comprises directing a flow of water under pressure toward said surface to separate said loosened decal therefrom.

6. The method of claim 1, wherein said step of separating said loosened decal comprises directing a flow of steam under pressure toward said surface to separate said loosened decal therefrom.

7. The method of claim 1 further comprising the step of drying said surface and decal before contacting with said composition.

8. A method of removing acrylic and polyester reflective decals from a surface comprising the steps of:

contacting said decals, for a period of time sufficient to loosen said decal from said surface, with a composition consisting essentially of:

| | (% by weight) |
|---|---|
| methylene chloride | 59% |
| methyl alcohol | 26% |
| methyl ethyl ketone | 4% |
| polyethylene glycol | 9% |
| methyl cellulose | 2% |

and;

separating said loosened decal from said surface.

* * * * *